US007261347B2

(12) United States Patent
Krieger

(10) Patent No.: US 7,261,347 B2
(45) Date of Patent: Aug. 28, 2007

(54) WASTE COLLECTION DEVICES

(76) Inventor: John M. Krieger, 351 Graham Rd., Cuyahoga Falls, OH (US) 44223

( * ) Notice: Subject to any disclaimer, the term of this patent is extended or adjusted under 35 U.S.C. 154(b) by 0 days.

(21) Appl. No.: 11/304,206

(22) Filed: Dec. 15, 2005

(65) Prior Publication Data

US 2006/0237978 A1 Oct. 26, 2006

Related U.S. Application Data

(63) Continuation-in-part of application No. 11/110,193, filed on Apr. 21, 2005.

(51) Int. Cl.
*A01K 29/00* (2006.01)
*E01H 1/12* (2006.01)

(52) U.S. Cl. ..... 294/1.4; 294/55

(58) Field of Classification Search ..... 294/1.1, 294/1.3, 1.4, 1.5, 31.2, 55; 15/257.1, 257.4, 15/257.7

See application file for complete search history.

(56) References Cited

U.S. PATENT DOCUMENTS

| | | | | | |
|---|---|---|---|---|---|
| 3,802,728 | A * | 4/1974 | Giacopelli | ..... | 294/1.4 |
| 3,910,619 | A * | 10/1975 | Schmieler | ..... | 294/1.4 |
| 4,005,892 | A * | 2/1977 | Williams | ..... | 294/1.4 |
| 4,562,611 | A * | 1/1986 | Marttinen | ..... | 15/257.7 |
| D333,888 | S * | 3/1993 | Visser | ..... | D30/162 |
| 5,702,138 | A * | 12/1997 | Elkind | ..... | 294/1.4 |
| 6,637,791 | B1 * | 10/2003 | Steadman | ..... | 294/1.3 |

* cited by examiner

*Primary Examiner*—Dean J. Kramer
(74) *Attorney, Agent, or Firm*—Renner, Kenner, Greive, Bobak, Taylor & Weber

(57) ABSTRACT

Various embodiments of waste collecting devices and systems provide structures for orienting a container for scooping up waste, and various structures for sealing such a container. The containers are preferably nesting containers such that they will lend themselves to being used as part of a waste collecting system.

3 Claims, 8 Drawing Sheets

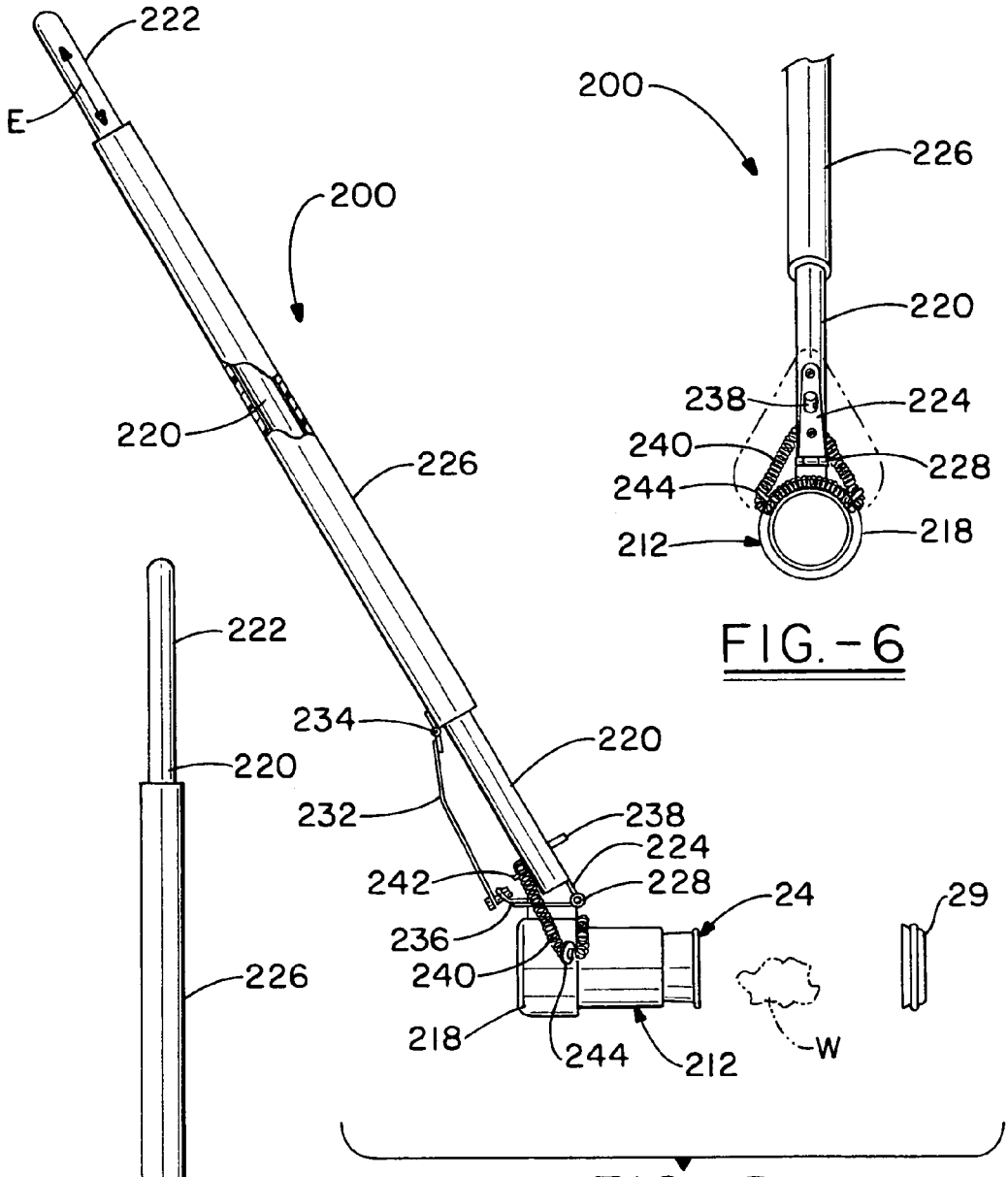
FIG.-5
FIG.-6
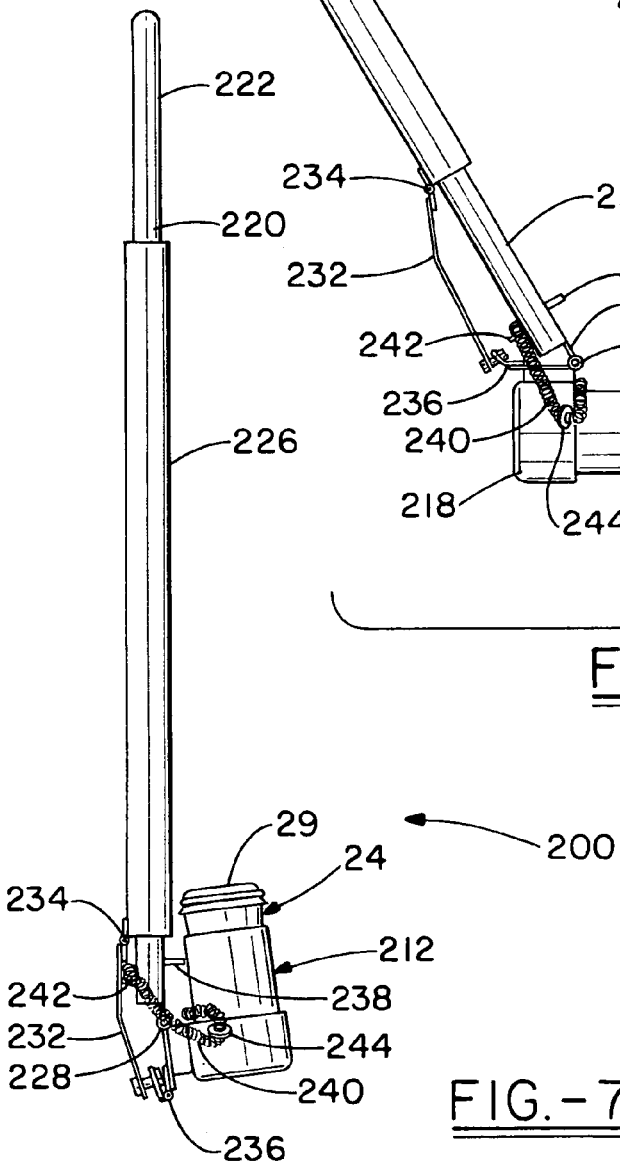
FIG.-7

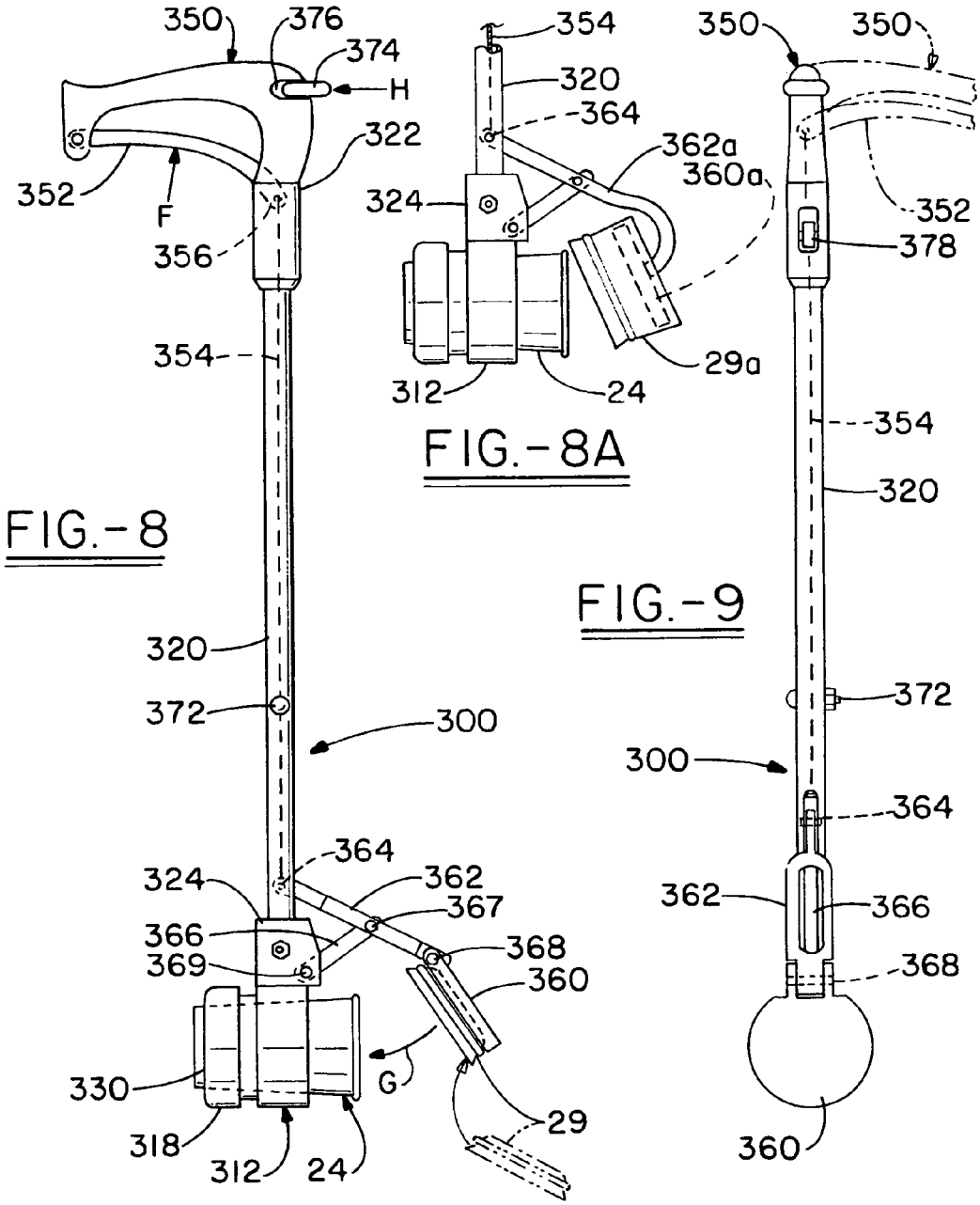
FIG.-8
FIG.-8A
FIG.-9
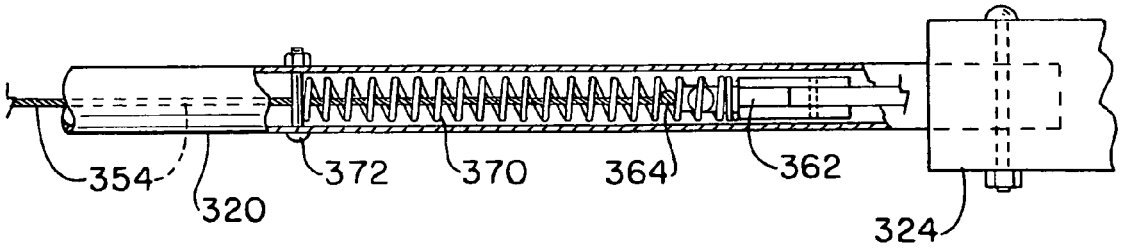
FIG.-10

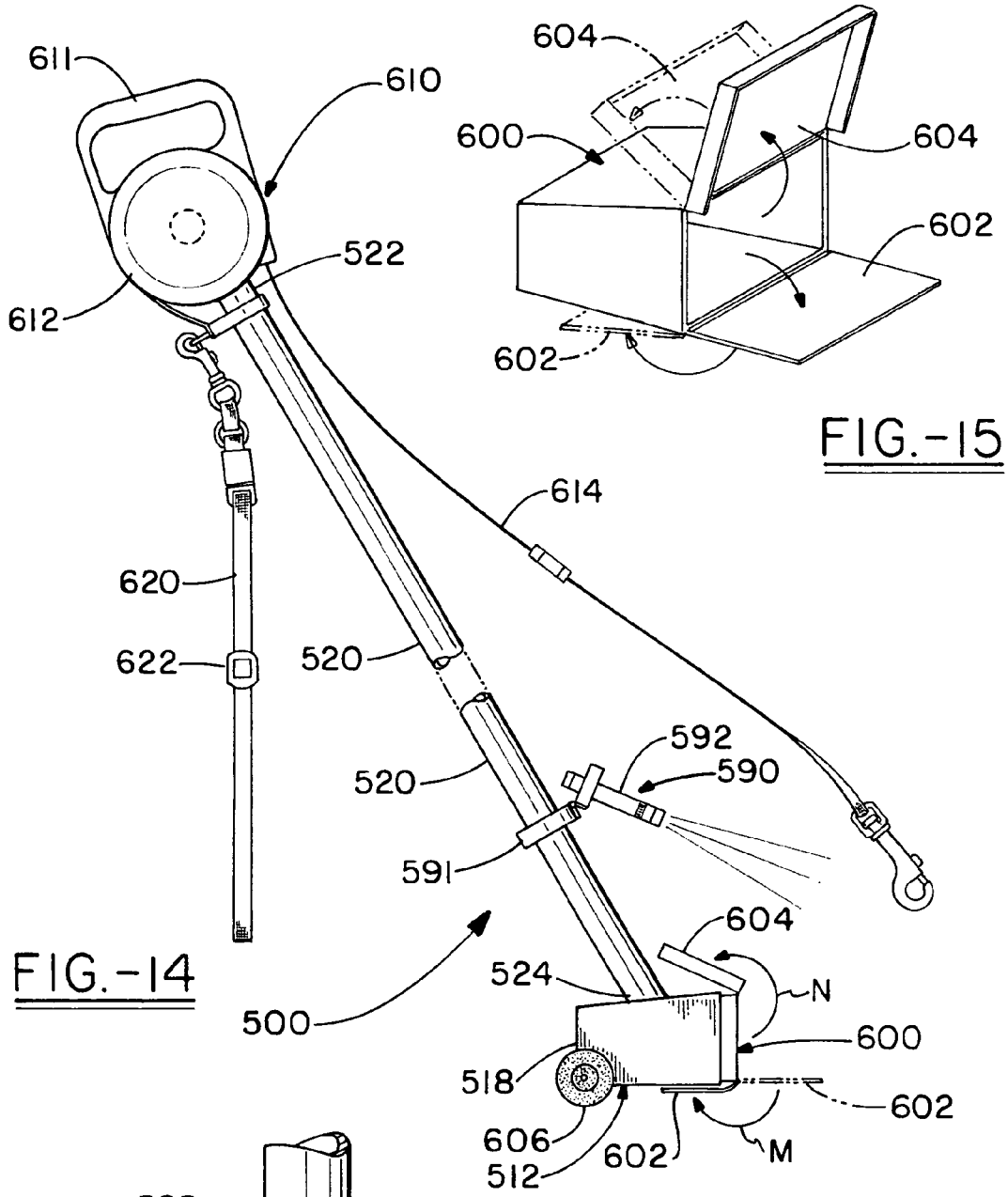
FIG.-14
FIG.-15
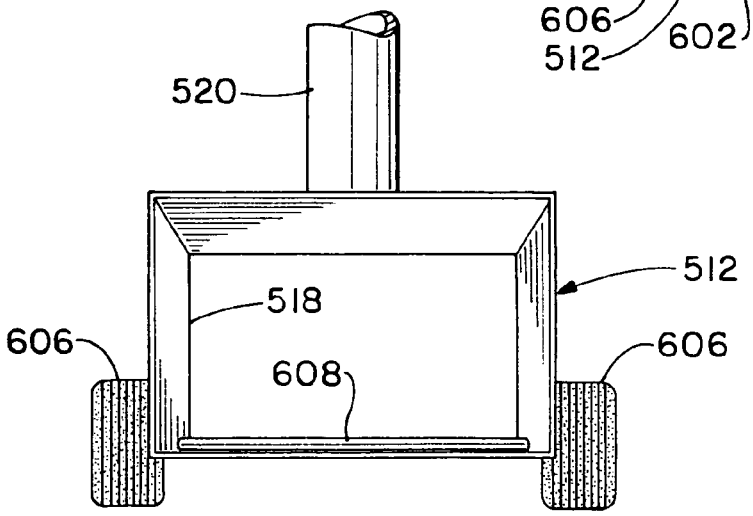
FIG.-16

WASTE COLLECTION DEVICES

CROSS REFERENCE TO RELATED APPLICATION

This is a continuation-in-part of patent application Ser. No. 11/110,193, filed Apr. 21, 2005, by the same title.

TECHNICAL FIELD

The present invention generally resides in the art of waste collection devices, particularly those that are employed to collect and dispose of animal waste, although their use is not limited thereto.

BACKGROUND OF THE INVENTION

Many different types of waste collection devices are provided in the prior art. Some use cooperating jaws that are operated by manipulating a squeeze handle to close those jaws around waste material. Others include disposable bags having their mouths secured around a frame. Waste is scooped up into the bag at the open mouth, and a squeeze handle or similar mechanism is actuated to bring a pivoting door against the open mouth to close the bag around the waste.

In use, these devices eventually require the operator to manipulate a bag of waste, and, in the case of animal waste, this can be quite disagreeable. Also, while manipulating the bag, one may encounter undesirable odors. Thus, the art could benefit from the use of more rigid containers and closures that would eliminate much of the disagreeable tactile and olfactory aspects of handling waste. Related to this need is the need for waste collection devices wherein the receptacle for the waste can be closed without having to directly manipulate the waste receptacle.

Animal waste collection is a daily occurrence for those who must walk their pets in public areas. Typically, the pet must be kept on a leash during these walks. Sometimes, this daily task must also be performed at night or at other times when visibility is poor. Yet, prior art waste collection devices are configured as individual devices that are carried in one hand while the animal's leash is carried in the other. Thus, there is a need in the art for a waste collecting device that also provides a pet leash, and facilitates the use of the device when it is dark. There is also a need that such waste collection devices be part of a system dedicated to waste collection.

SUMMARY OF THE INVENTION

This invention provides waste collecting devices. In conjunction with a plurality of nesting containers, it also provides waste collecting systems that are user-friendly, clean and efficient.

In one embodiment, this invention provides a waste collecting device comprising a support shaft having a grip end and a receptacle end; a shaft sleeve receiving said support shaft with said grip end and said receptacle end extending outside of said shaft sleeve; a receptacle having a rear end and an open front end; a container selectively received in said receptacle, said container having an open top end for receiving waste and a closed bottom end, said receptacle being pivotally secured to said support shaft at a fulcrum at said receptacle end, between said rear end and said open front end of said receptacle; and a push bracket secured between said shaft sleeve and said container, and pivotally connecting to said receptacle at a position rearward of said fulcrum such that movement of said support shaft relative to said shaft sleeve pivots said receptacle and said container received therein about said fulcrum at said receptacle end.

In another embodiment, a waste collecting device is provided comprising a support shaft having a grip end and a receptacle end; a container receptacle having a rear end and an open front end, and secured to said support shaft at said receptacle end; a container selectively received in said container receptacle, said container having an open top end for receiving waste and a closed bottom end; a lid receptacle selectively movable between a rest position distanced from said open end of said container when said container is received in said container receptacle and a capping position pressing on said open end of said container when said container is received in said container receptacle; a squeeze handle, at said handle end of said support shaft, actuated to move said lid receptacle between said rest position and said capping position; and a lid held in said lid receptacle and secured to said open end of said container though actuation of said squeeze handle.

In yet another embodiment, a waste collecting device is provided comprising a support shaft having a grip end and a receptacle end; a container receptacle having a rear end and an open front end, and pivotally secured to said receptacle end of said support shaft between said rear end and said open front end; a container selectively received in said container receptacle, said container having an open top end for receiving waste and a closed bottom end; a squeeze handle, at said grip end of said support shaft, actuated to move said container receptacle from a lid receipt position to a scooping position, said lid receipt position being substantially parallel to said support shaft, holding said waste container upright, with said open top end of said waste container above said closed bottom end, and said scooping position being substantially normal to said support shaft, holding said waste container sideways, with said open top end in front of said closed bottom end; and a lid receptacle selectively movable between a rest position distanced from said open end of said container, when said waste container is received in said container receptacle and held in said cap receipt position, and a capping position wherein said lid receptacle presses against said open end of said waste container, when said waste container is received in said container receptacle; a lid held in said lid receptacle and secured to said open end of said waste container though movement of said lid receptacle to said capping position, when said waste container is held in said lid receipt position.

In an embodiment particularly suited for animal waste collection, this invention provides a waste collecting device comprising a support shaft having a grip end and a receptacle end; a container receptacle having a rear end and an open front end and secured to said receptacle end of said support shaft, a container selectively received in said container receptacle through said open front end, said container having an open top end for receiving waste and a closed bottom end, and a leash device provided at said grip end of said support shaft and providing a grip, a retracting spool, and a leash secured to said retracting spool, said retracting spool being biased to a position in which said leash is wound around said retracting spool, wherein extending said leash from around said retracting spool acts against the bias on said retracting spool.

In another embodiment of a waste collecting device, there is provided an elongated shaft having first and second ends; a handle provided on said first end of said shaft; a cup holder; a hinged interconnection between said cup holder and said second end of said shaft; and an actuator interposed between said shaft and said hinged interconnection, said actuator and said hinged interconnection effecting pivotal movement of said cup holder about said second end of said shaft between first and second operative extremes, said first operative extreme accommodating waste collection through movement of said shaft in a first direction, and said second operative extreme accommodating waste collection through movement of said shaft in a second direction opposite said first direction.

In conjunction with nesting containers, any one of these embodiments for a waste collecting device might be employed as part of a waste collecting system that is user-friendly, clean and efficient. Thus this invention also provides a waste collecting device and system comprising a plurality of nesting containers; and a waste collecting device including a receptacle that selectively receives one of said plurality of nesting containers.

BRIEF DESCRIPTION OF THE DRAWINGS

FIG. 5 is a side elevational view of a third embodiment which may be tipped vertically for carrying a completed collection;

FIG. 6 is a front elevational view of the device shown in FIG. 5 absent a container;

FIG. 7 is a side elevational view showing the device in the upright position;

FIG. 8 is a side elevational view of a fourth embodiment that includes a lid receptacle that affixes a lid to the container as it is maintained in a receptacle;

FIG. 8A is a partial side elevational view of the device of FIG. 8, modified to accommodate a lid of protective design;

FIG. 9 is a front elevational view of the device shown in FIG. 8 with the lid receptacle positioned against the container;

FIG. 10 is a partially broken away view of the support shaft showing the movement mechanics for the lid receptacle;

FIG. 14 is a side elevational view of a sixth embodiment which comprises a leash, flashlight, and other features useful when walking a dog;

FIG. 15 is a perspective view of the container for the device of FIG. 14;

FIG. 16 is a front elevational view of the container receptacle absent a container;

PREFERRED EMBODIMENT FOR CARRYING OUT THE INVENTION

Various embodiments for waste collecting devices are provided herein. Each of these devices, in conjunction with nesting containers, can be used as part of a user-friendly, clean and efficient system for collecting waste. The aspects common to all embodiments will be apparent, and it will be appreciated that, while particular advantages and alternatives offered by a common aspect might be described with respect to one embodiment, it will not necessarily be repeated for each embodiment, in the interest of avoiding redundancy. Moreover, it will be appreciated that the various features of the embodiments presented are readily interchangeable among the various embodiments while remaining within the scope of the invention presented herein.

Figure 1:
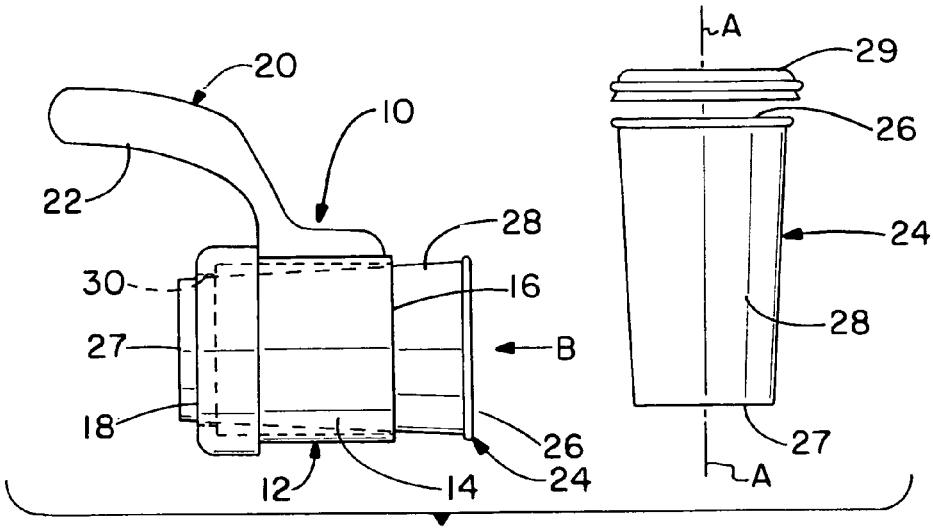
FIG. 1 is a side elevational view of a first embodiment of a waste collection device and associated container.
Figure 2:
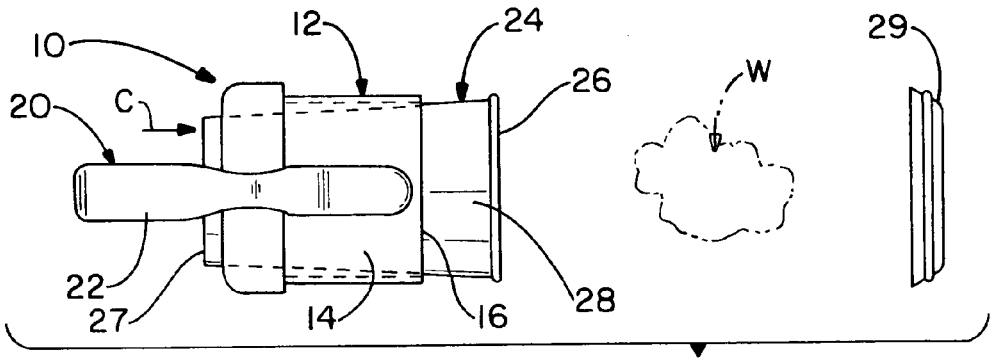
FIG. 2 is a top view of the device of FIG. 1 illustrating the manner of its use.
Figure 3:
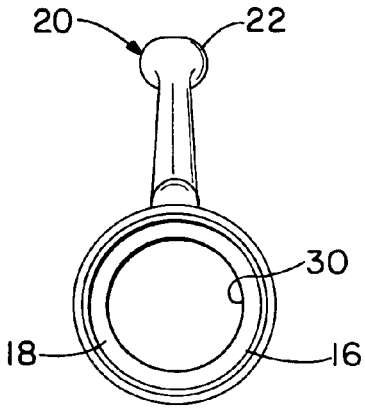
FIG. 3 is a front elevational view of the device absent a container.

Referring now to FIGS. 1-3, a first embodiment of a waste collecting device is shown and designated by the numeral 10. Waste collecting device 10 includes receptacle 12, having body portion 14 that extends from open front end 16 to an opposed butt end 18. Handle 20 extends from body portion 14 and provides grip 22. Device 10 is used with one of a plurality of nesting containers 24. In the figure, one such container 24 is shown, having open top 26, closed bottom 27, and tapered side wall 28. Container 24 has a taper, with no surfaces being parallel to a longitudinal axis A of the container 24, such that a plurality of containers 24 may be intimately stacked on and nested within each other. This nesting function is not shown here, as it is redundant of generally known information. It will be appreciated that various types of nesting containers may be provided, differing in shape and size from container 24, and waste collecting devices disclosed herein can be readily adapted to accept such different shapes and sizes. The containers used in conjunction with the waste collecting devices of this invention are preferably rigid or semi-rigid and made from a wax coated or other suitable material that is not negatively affected by wet waste materials. Regardless of the actual size and shape that is chosen for the container, an appropriate lid 29 is provided for being secured around open top 26. Lids 29 are also preferably nesting lids, and in that regard, are slightly tapered.

A single container 24 fits within receptacle 12 by having closed bottom 27 inserted through open front end 16 to engage butt aperture 30 at tapered side wall 28. It will be appreciated that, as container 24 is further inserted in the direction of arrow B, the diameter of container 24, at the area of butt aperture 30, constantly increases until side wall 28 engages butt aperture 30 through a friction fit. This holds container 24 with the plane defined by open top 26 of container 24 slightly off of perpendicular with the axis of grip 22 of handle 20, forming an angle therewith on the order of 70-90 degrees. With such a configuration, one can scoop waste W off the ground, as can be appreciated in FIG. 2. After scooping up waste W, one can manually secure lid 29 to open top 26 of container 24. Because container 24 is rigid or semi-rigid, much of the disagreeable tactile sensations are avoided, and, because lid 29 is secured to open top 26 of container 24, any disagreeable smells are at the very least lessened, if not completely eliminated. Once waste W is sealed in container 24, as described above, tapping on closed bottom 27 of container 24, in the direction of arrow C (FIG. 2) overcomes the friction fit retention of container 24 in receptacle 12, and the sealed container may be properly disposed.

This hand-held embodiment of FIGS. 1-3 is easy to use, and, in conjunction with nesting containers, such as container 24, provides a user-friendly, clean and efficient system for collecting waste, particularly animal waste. Waste collecting device 10 and a plurality of containers 24 would be provided, and one using device 10 could locate a plurality of containers 24 at a convenient location for daily use, for example, in close proximity to an animal's leash, for those using devices herein for animal waste collection. The containers would be preferably inexpensive enough to be disposed of after each use, although it is not necessary that they be disposable. The one using the device benefits from such a user-friendly system, while the entity providing waste collecting device 10 may benefit from continued sales of disposable containers configured to associate with the waste collecting device. In addition, the rigidity of the containers and the fact that they are sealed with a lid provides added benefits. These benefits are also realized in the remainder of the waste collection device embodiments herein.

Figure 4:
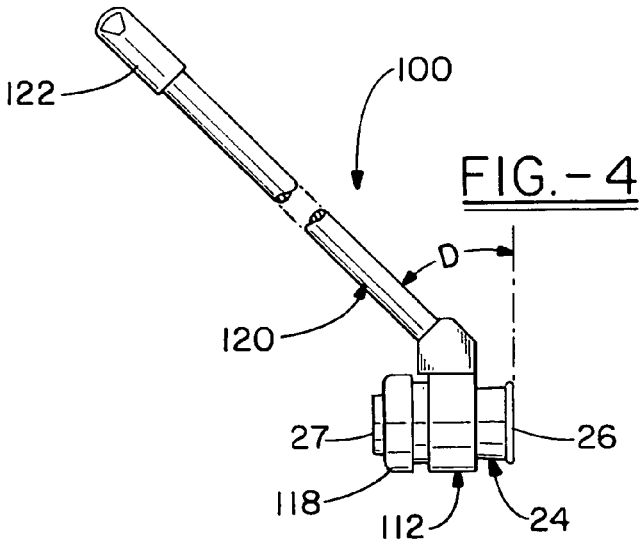
FIG. 4 is a side elevational view of a second embodiment which has an extended handle such that one does not have to stoop down to make the collection.

With short handle 20 and grip 22 in close proximity to container 24, one using device 10 must get relatively close to the waste being collected. Thus, although device 10 is certainly efficient and useful, it may be desired to extend handle 20 to place grip portion 22 much further from container 24. Such an embodiment is shown in FIG. 4, and designated by the numeral 100. Therein, like parts to the embodiment of FIGS. 1-3 receive like numerals, although increased by 100. Particularly, handle 120 provides a much longer extension from receptacle 112 to grip 122, having a length of 24 to 40 inches. Notably, grip 122 extends along a line that intersects the plane defined by open top 26 of a container 24 retained in receptacle 112. Preferably, grip 122 extends along a line that intersects this plane at an angle D of from 20 to 60 degrees.

Referring now to FIGS. 5-7, another embodiment is shown and designated by the numeral 200. Waste collecting device 200 is shown adapted for use with containers 24, and the disclosure herein above with respect to containers 24, regarding the fact that they may take other shapes and sizes, is also applicable in this embodiment. Indeed, nearly all embodiments are shown herein using a container 24, and the disclosure with respect to container 24 is applicable to all such embodiments. Waste collection device 200 includes support shaft 220 having grip end 222 and receptacle end 224. Support shaft 222 is received within shaft sleeve 226, and may telescope therein as indicated by the double ended arrow E. Both handle end 222 and receptacle 224 extend outside of shaft sleeve 226. Receptacle 212 is pivotally secured to receptacle end 224 of support shaft 220 as at fulcrum 228, and may pivot by means of telescoping support shaft 220 within shaft sleeve 226, between the use position of FIG. 5 and the rest position of FIG. 7. More particularly, push bracket 232 is secured to shaft sleeve 226 at hinge 234, and is secured to receptacle 212 at hinge 236, at a position rearward of fulcrum 228, as in the orientation in FIG. 5. Push bracket 232 moves with shaft sleeve 226 such that moving shaft sleeve 226 toward receptacle end 224 pushes on receptacle 212, rearward of fulcrum 228, in order to pivot receptacle 212 and container 24 to the upright position shown in FIG. 7. Pulling back on shaft sleeve 226, in the direction of grip end 222 will rotate receptacle 212 in the other direction to the position shown in FIG. 5. Thus, waste W may be scooped up in the orientation of FIG. 5, and lid 29 may be placed on container 24 and the container 24 may be thrown away from the position of FIG. 7. Notably, container 24 does not extend out through an aperture in butt end 218 of receptacle 212 inasmuch as, rather than tapping on the bottom end 27 of container 24 to remove it from receptacle 212, it may be simply grasped and pulled out of receptacle 212 from the orientation shown in FIG. 7. It should be appreciated that receptacle 212 could include a butt aperture as in the previous embodiments.

In FIG. 7, it can be seen that stop 238 limits the movement of receptacle 212. It will be appreciated that this could also be accomplished by a stop on support shaft 220, limiting the range of movement of shaft sleeve 226. In preferred embodiments, spring 240 is employed to urge receptacle 212 to both the use position of FIG. 5 and the rest position of FIG. 7. Particularly, spring 240 is secured to receptacle end 224 of support shaft 220, at pin 242, and is secured to receptacle 212 at a position 244 that is slightly in front of fulcrum 228, in the rest position of FIG. 7, and slightly behind fulcrum 228 in the use position of FIG. 5. It will be appreciated that spring 240 is stretched to a maximum distance somewhere between these two positions, and, once this distance of maximum stretch is passed, spring 240 will pull on receptacle 212 to pivot receptacle 212 the rest of the way to the position sought.

Those skilled in the art will appreciate that a decorative cover (not shown) would typically be provided to cover the working end mechanisms such as push bracket 232, hinge 236 and spring 240, and to provide aesthetics to the assembly as a whole. Other modifications or additions, such as implementing the hinge 236 as a "living hinge" are also contemplated by the invention of FIGS. 5-7.

With reference to FIGS. 8-10, yet another embodiment of a waste collecting device is shown and designated by the numeral 300. Device 300 includes support shaft 320 having grip end 322 and receptacle end 324. Receptacle 312 extends from receptacle end 324, and, in this embodiment, is very similar to receptacle 12, having butt end 318 and butt aperture 330 for receiving a container 24. Squeeze handle 350 is provided at grip end 322, and has a lever 352 that is squeezed in the direction of arrow F to move lid receptacle 360 in the direction of arrow G, to seal lid 29 onto container 24.

As seen in FIG. 10, cable 354 extends from its connection to lever arm 362, as represented at 364, to connect to movable end 356 of lever 352. Lever arm 362 is secured to fulcrum shaft 366 at fulcrum 367, between its connection to cable 354 at 364, and its connection to lid receptacle 360 at 368. Fulcrum shaft 366 is pivotally secured to receptacle end 324 of shaft 320 at pivot 369. As will be appreciated from the figures and from a general appreciation of fulcrums and lever arms, squeezing lever 352 in the direction of arrow F pulls on cable 354, pulling on lever arm 362 to pivot it around fulcrum 367, with fulcrum shaft 366 also pivoting around its receptacle end 324, ultimately bringing lid receptacle 360 in the direction of arrow G to place lid 29 on container 24. As best seen in FIG. 10, lever arm 362, and its associated elements for moving lid receptacle 360 is urged to the position of FIG. 8 through bias spring 370 acting between stop 372 and lever arm 362.

When lever 352 is squeezed in the direction of arrow F, its movable end 356 is brought into alignment with latch 374 that may slide within groove 376 in the direction of arrow H. When aligned in this manner, latch 374 may be pushed in the direction of arrow H, and an extension within handle 350 engages movable end 356 of lever 352 to prevent lever 352 from moving in a direction opposite arrow F. This keeps lid receptacle 360 in the closed position on container 24. Another latch 378 on handle 350 is movable to engage catches in support shaft 320, and permit the handle 350 to rotate and latch at various points, as seen in phantom in FIG. 9, where it is latched at 90 degrees.

Lid receptacle 360 is appropriately configured to receive lid 29, with its open end facing the open end of container 24. Lid receptacle 360 engages lid 29 through a friction fit that is weaker than the fit between lid 29 and container 24 when lid 29 is placed thereon. In this way, once lid receptacle 360 has been moved in the direction of arrow G, and a lid 29 has been placed on container 24, releasing lever 352 to move lid receptacle 360 in the direction opposite arrow G will leave lid 29 behind, secured to container 24. This concept is repeated in other embodiments having lid receptacles that place lids on containers. Similarly, the cups or containers 24 may be nestingly received by each other within receptacle 312 and butt end 318 such that when a lid 29 is placed upon the open end of the first container 24 as just described, that capped container 24 may be removed from the nested stack and disposed, leaving the next container 24 and lid 29 for subsequent operations. In effect, this and subsequent embodiments of the invention contemplates a magazine of receptacles and lids.

Since the embodiment of FIGS. 8-10 contemplates the use of the lid 29 to urge the waste into the container 24, it is desirous to configure the lid 29 and its receptacle 360 to protect the receptacle and subsequent lids from waste smearage. In that regard, reference is made to FIG. 8A, wherein the structure of FIGS. 8-10 is repeated, with minor modifications to the lid 29*a* and to the lid receptacle 360*a* and lever arm 362*a*. As shown, the lid 29*a* has a recessed top that fully receives the lid receptacle 360*a*, which is positioned at the crook end of the lever arm 362*a*. Any smearage of waste will necessarily be along the truncated elongated conical exterior sides of the lid 29*a*, and not on subsequent lids within the magazine or on the lid receptacle 360*a*.

Figure 11:
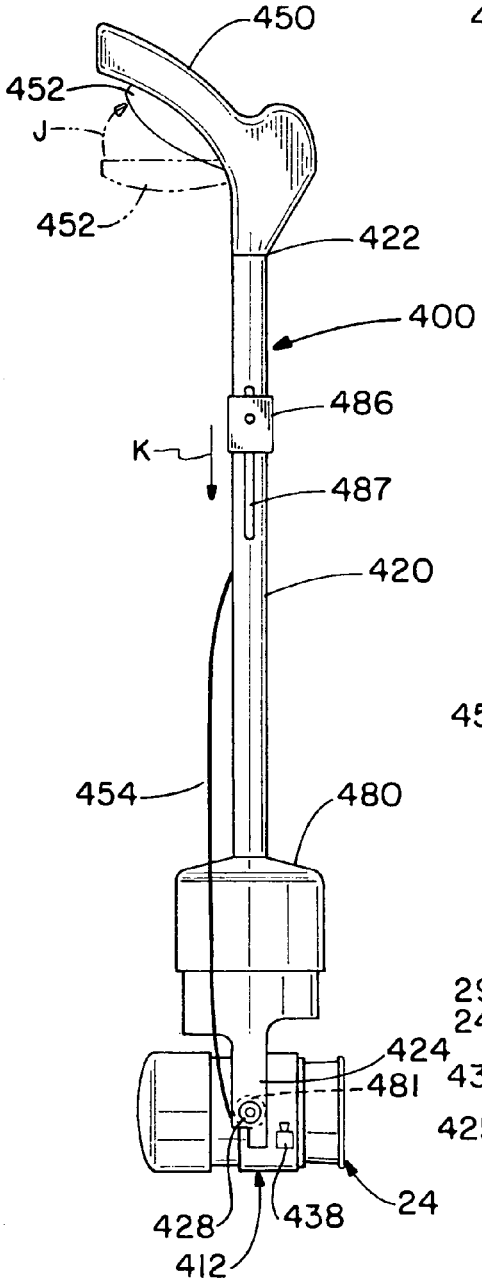
FIG. 11 is a side elevational view of a fifth embodiment wherein the container receptacle pivots between a use position (shown) and a rest position in which the container may be closed by movement of a lid receptacle.
Figure 12:
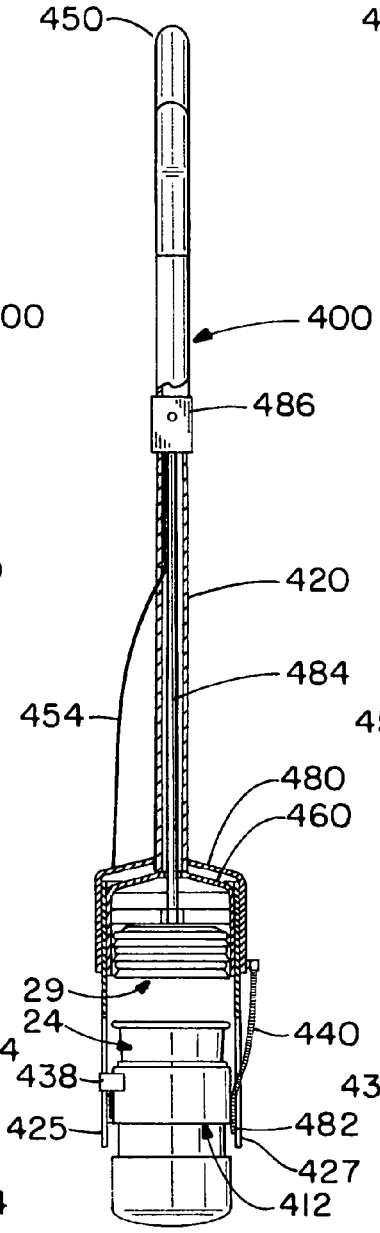
FIG. 12 is a front elevational view, in partial section, showing the internal configuration of the device shown in FIG. 11 prior to moving a lid onto the upright-oriented container.
Figure 13:
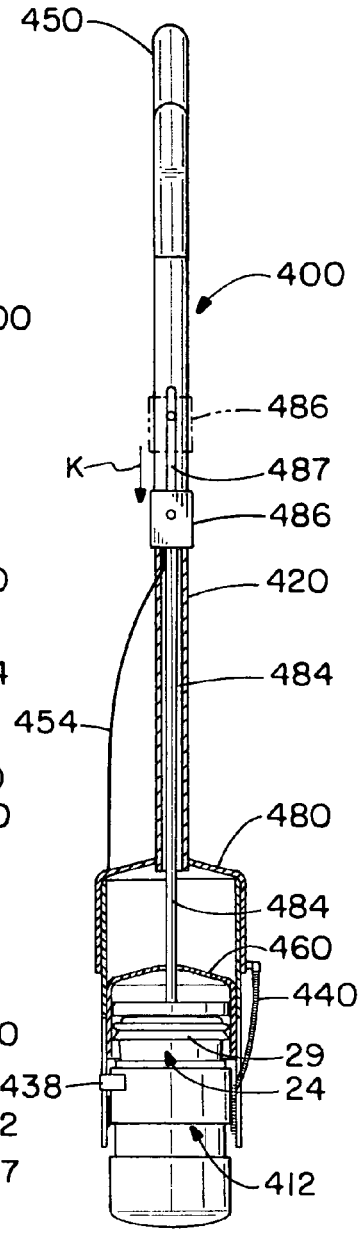
FIG. 13 is a front elevational view similar to FIG. 12 but showing a downward movement of the lid receptacle so as to affix a lid to the container.

With reference to FIGS. 11-13, yet another embodiment for a waste collection device is shown and designated by the numeral 400. Device 400 includes support shaft 420 having a grip end 422 and receptacle end 424. Notably, in this embodiment, receptacle end 424 lies below lid receptacle housing 480, which is still considered to be part of support shaft 420 inasmuch as it still provides physical support structure. Squeeze handle 450 extends from grip end 422, and provides squeeze lever 452 that is movable between a rest position (shown in phantom) and a use position (non-phantom) as represented by the arrow J. Moving lever 452 in the direction of arrow J (to the non-phantom position) pulls on cable 454, to pivot receptacle 412 about hinge 428. More particularly, cable 454 extends around disk 481 below the bottom periphery thereof and connects above the center thereof, along the circumference, such that pulling on cable 454 in the direction of handle 450 rotates disk 481 to rotate receptacle 412 to the position shown in FIG. 11. That is, squeezing lever 452 rotates disk 481 and therefore rotates receptacle 412 attached thereto. This rotation is made against the force of spring 440 which is secured between housing 480 and another similar disk 482 on the other side of receptacle 412. Spring 440 extends around disk 482 in a direction opposite the direction that cable 454 extends around disk 481. When receptacle 412 is pivoted to the position of FIG. 11, as already disclosed, spring 440 is stretched such that, when the tension on cable 454 is released, spring 440 pulls receptacle 412 back to the position of FIGS. 12 and 13. Thus, lever 452 is squeezed to place receptacle 412 and container 24 in the appropriate location for scooping up waste, and the handle is released to bring receptacle 412 and container 424 upright. The action of spring 440 is limited by stop member 438 on receptacle 412. Stop member 438 contacts one of the opposed support members 425, 427 of receptacle end 424.

In the position of FIGS. 12 and 13, lid 29 may be placed on container 24 held within receptacle 412. More particularly, lid receptacle 460 is retained within housing 480, and retains at least one lid 29 through a force that is less than the force with which container 24 holds lid 29 when lid 29 is secured to the open top of container 24. Lid receptacle 460 is part of a telescoping mechanism consisting of lid receptacle 460, telescoping shaft 484, and slide 486. Slide 486 can move within slot 487 provided in support shaft 420, and acts on telescoping shaft 484 to move lid receptacle 460 between the rest position shown in FIG. 12 and the capping position shown in FIG. 13. When slide 486 is pushed in the direction of arrow K, lid receptacle 460 is forced toward container 24, and a lid 29 retained in lid receptacle 460 is forced onto the open end of the container. Drawing slide 486 in the direction opposite arrow K pulls lid receptacle 460 off of container 24, leaving lid 29 behind. Slide 486 may be spring biased to the rest position by a spring fit internally of shaft 420.

Again, as with the embodiment of FIGS. 8-10, the receptacle 412 may receive and maintain a magazine of containers 24, and the lid receptacle 460 may be configured to receive a magazine of lids 29, as earlier discussed. Accordingly, the device 400 may be loaded for a reasonable number of sequential activations, the removal of a container 24 sealed by a lid 29 rendering the next container and lid available for implementation in the next retrieval and disposal operation.

Referring now to FIGS. 14-16, yet another embodiment for a waste collecting device is shown and designated by the numeral 500. This embodiment is most specifically directed toward the collection of animal waste, because it provides a leash for walking an animal. Additionally, it provides a flashlight making it suitable or use in the dark. Each of these aspects is more specifically disclosed below.

Device 500 includes a support shaft 520 having a grip end 522 opposite a receptacle end 524. Light device 590 is provided along support shaft 520, between grip end 522 and receptacle end 524. Light device 590 includes support bracket 591, which, in the embodiment shown, has a pivoting section to direct a flashlight 592 out in front of receptacle 512. Receptacle 512 can take virtually any form already provided herein, but, in the embodiment shown, is a tapered box of rectangular cross-section, as seen in the figures. As seen in FIG. 15, receptacle 512 is to receive waste container 600, which preferably has integral inner lid flap 602 and cover flap 604. As seen in FIG. 14, waste container 600 fits securely within receptacle 512. Receptacle 512 has wheels 606 mounted to butt end 518 thereof. As seen in FIG. 16, axle 608 for wheels 606 extends through the rear portion of receptacle 512. In use, inner flap 602 would be folded underneath container 512, in the direction of arrow M. Closure flap 604 would be pivoted in the direction of arrow N. Thus, receptacle 512 may be rolled on wheels 606 to scoop up waste. Thereafter, the flaps could be closed and container 600 disposed of.

At grip end 522, a common retractable leash device 610 is provided. This device has a grip 611 and spring-loaded retracting spool 612, which may feed out a leash 614 for securement to an animal's collar, as generally known. Retracting spool 612, in a well-known manner, is biased to the position in which the least 614 is wound about the spool, and extending the leash 614 from spool 612 must act against this bias. A shoulder strap 620 is provided proximate grip end 522, and generally provides a loop of material to go over the shoulder. The length of shoulder strap 620 and the loop of material it forms can be changed at buckle 622, as generally known. The embodiment of FIG. 14 thus provides a waste collection device that is particularly suitable for animal waste collection, and eliminates the need for carrying around separate leash and waste collection devices, as is generally done now in the prior art. The device is also suitable for use when walking an animal at night.

Figure 17:
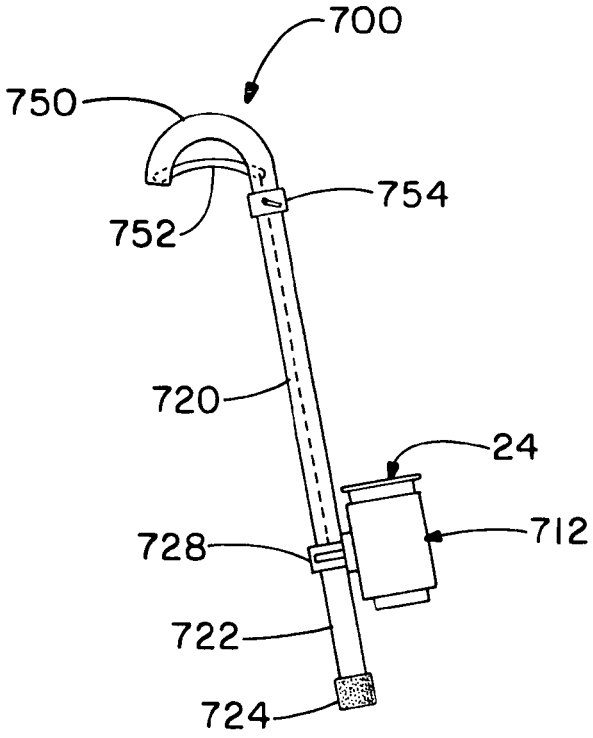
FIG. 17 is a side elevational view of a seventh embodiment, comprising a walking cane structure with pivotal handle and cup receptacle, shown in the cane mode.
Figure 18:
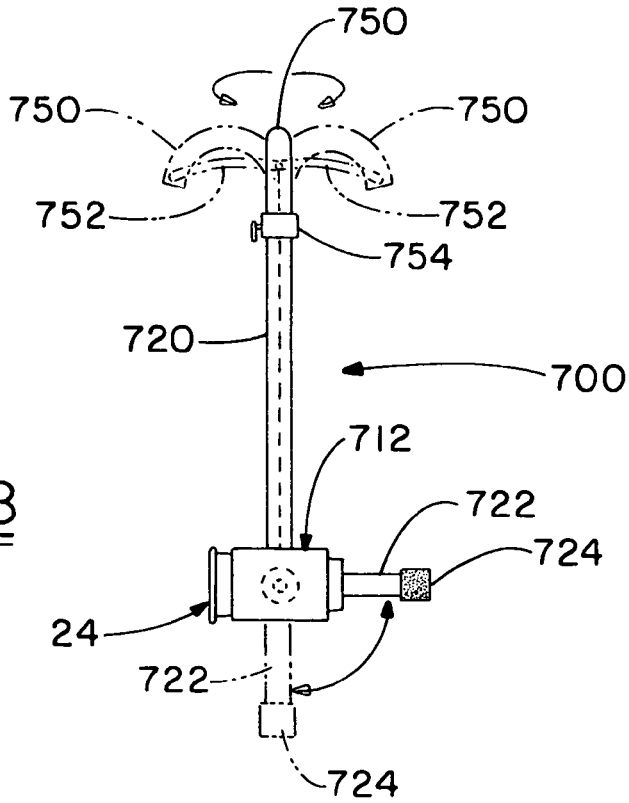
FIG. 18 is a side elevational view of the embodiment of FIG. 17, shown in the waste collection mode.

Referring now to FIGS. 17 and 18, yet a further embodiment of the invention is shown as designated by the numeral 700. Here, the invention contemplates a waste collecting device configured as a walking cane, wherein a shaft 720 has a handle 750 extending therefrom. A squeeze lever 752 connects to an inner cable as in FIGS. 8 and 11. The cable connects to a shaft end portion 722 that may include a tip cap 724. The shaft end portion 722 is attached to a receptacle 712 for receiving containers 24, as previously described. As with the embodiment of FIG. 11, the shaft end portion 722 and attached receptacle 712 are adapted to pivot around hinge 728 from the cane position of FIG. 17 to the active receiving position of FIG. 18, by actuation of the squeeze lever 752.

It is further contemplated that the handle 750 may be selectively positioned as to its orientation with regard to the receptacle 712 when pivoted as shown in FIG. 18. This accommodates pushing, pulling, or otherwise moving the container 24 toward the waste for retrieval. To this end, a collar 754 interconnects the handle 750 and shaft 720 in interlocking relative rotational engagement. With the collar 754 attached to the handle 750 and having a spring loaded pin therein, the pin may be retracted and the handle rotated to a desired position where the pin is released to engage one of a plurality of holes circumscribing the top of the shaft 720.

Referring now to FIGS. 19-23, an appreciation may be obtained of yet another embodiment of the invention. As shown, such embodiment is designated generally by the numeral 800, and comprises an elongated shaft 810 having a handle 812 at one end thereof. While the handle 812 may be of various configurations, it is preferred that the handle comprise a straight handle, as shown, in order to accommodate the ability to push or pull the device in retrieving waste, as will be discussed below. In any event, it is contemplated that the handle 812 is textured or otherwise finished for purposes of accommodating hand gripping by the user.

A shoulder or wrist strap 814 may be connected to the shaft 810 by means of a clip 816 engaging an eye 818. A sleeve 820 is provided over the shaft 810 in reciprocating sliding engagement therewith. The sleeve 820 preferably has at least one aperture 822 therein adapted to receive a spring biased ball 824 that is nested within the shaft 810. The aperture 822 and ball 824 allow for selective locking engagement of the sleeve 820 upon the shaft 810 and, for such purpose, multiple apertures 822 might be employed.

A cup receptacle 826 may be mounted upon the sleeve 820 by means of appropriate clamps 828 or the like. The receptacle 826 has a removable cap 830 thereon. The receptacle 826 may receive the waste cup and associated lids for waste retrieval, as will be discussed below.

A collar 832 is received upon a lower end of the sleeve 820 and includes a top hinge 834 interconnected through a linkage rod or plate 836 to a bottom hinge 838. The bottom hinge 838 is connected to a top end of bracket 840. A hinge 842 is interposed between the bracket 840 and the lower end of the shaft 810, with hinge plates connected to each. A cup holder 844 is attached to the bracket 840, the cup holder 844 being configured to grippingly and releasably receiving a cup 846.

To allow the device 800 to be used simply as a cane or walking stick, rubber bumpers or legs 848, 850 are provided at the bottom of the bracket 840 and cup holder 844, respectively.

In order to facilitate removal of the cup 846 from the holder 848 after a waste retrieval operation, or otherwise, a release mechanism is provided. A lever 852 is connected to a hinge pin 854 and to a plate 856 which is interior of the cup holder 844 and positioned directly beneath the bottom of the cup 846 when it is received thereby. Depressing of the lever 852 causes the plate 856 to move upwardly about the pivot pin 854, pushing the cup 846 upwardly and out of engagement with the interior of the cup holder 844.

Figure 21:
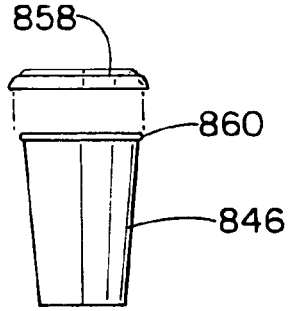
FIG. 21 is an elevational view of a cup and lid as may be applied for use with the embodiment of FIG. 19.

As shown in FIG. 21, the cup 846 may be of any suitable nature, but is preferably of a tapered cylindrical structure. An enlarged lip 860 circumscribes the upper opening of the cup 846 and is adapted to matingly receive a cap 858 that may be snap-fit thereover.

Figure 19:
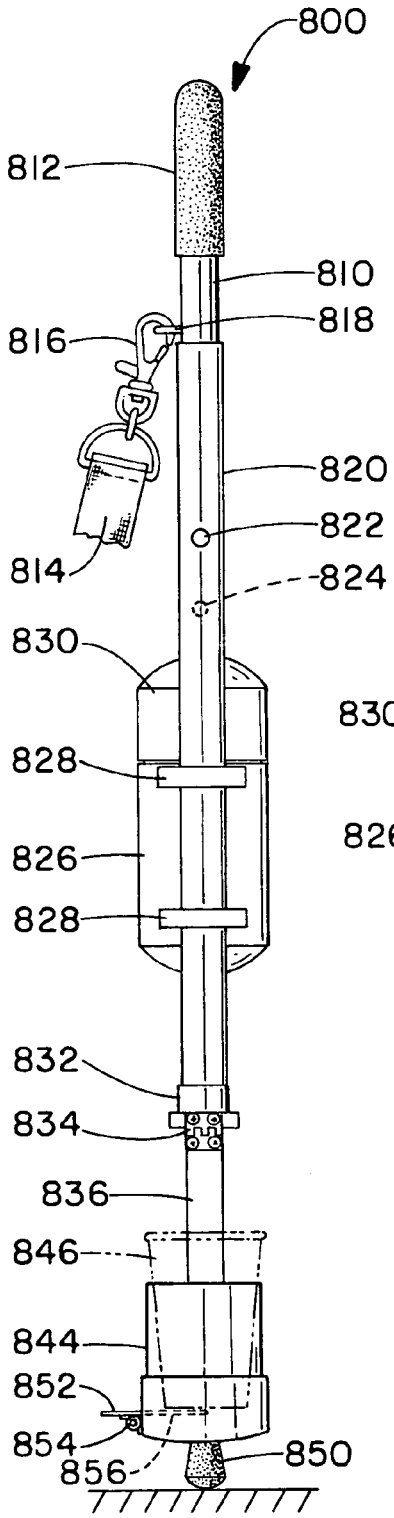
FIG. 19 is a front elevational view of an eighth embodiment of the invention.
Figure 20:
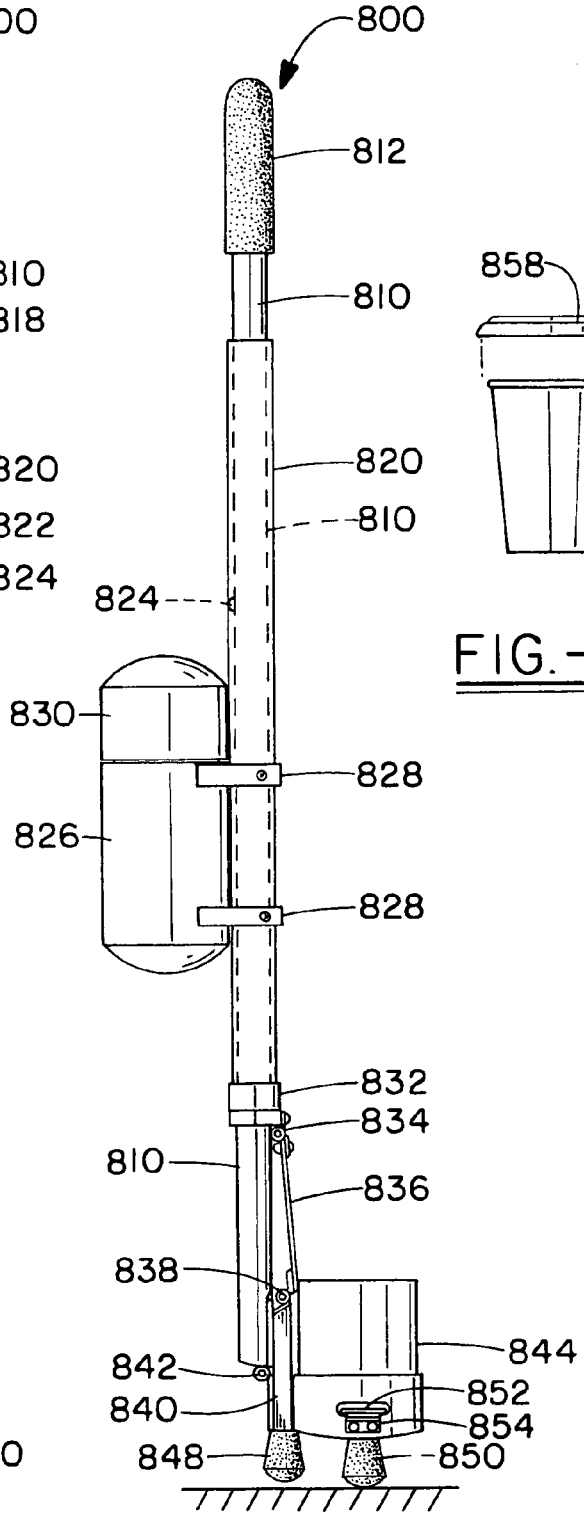
FIG. 20 is a left side elevational view of the embodiment shown in FIG. 19.
Figure 23:
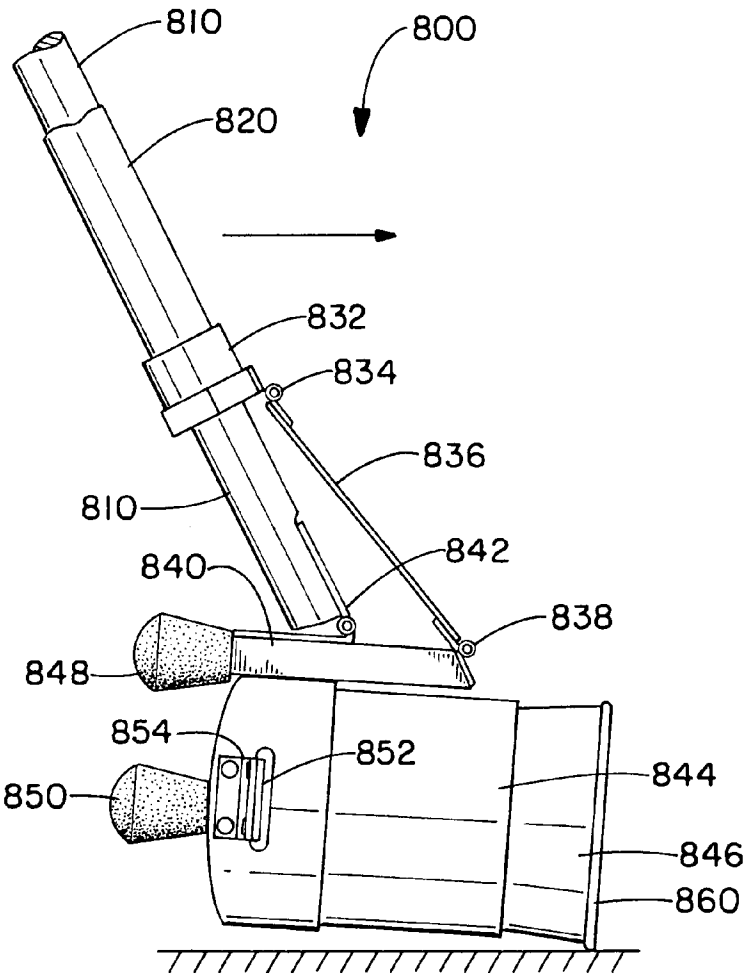
FIG. 23 is an enlarged partial left side elevational view of the eighth embodiment as it may be pushed in the process of using the device.
Figure 22:
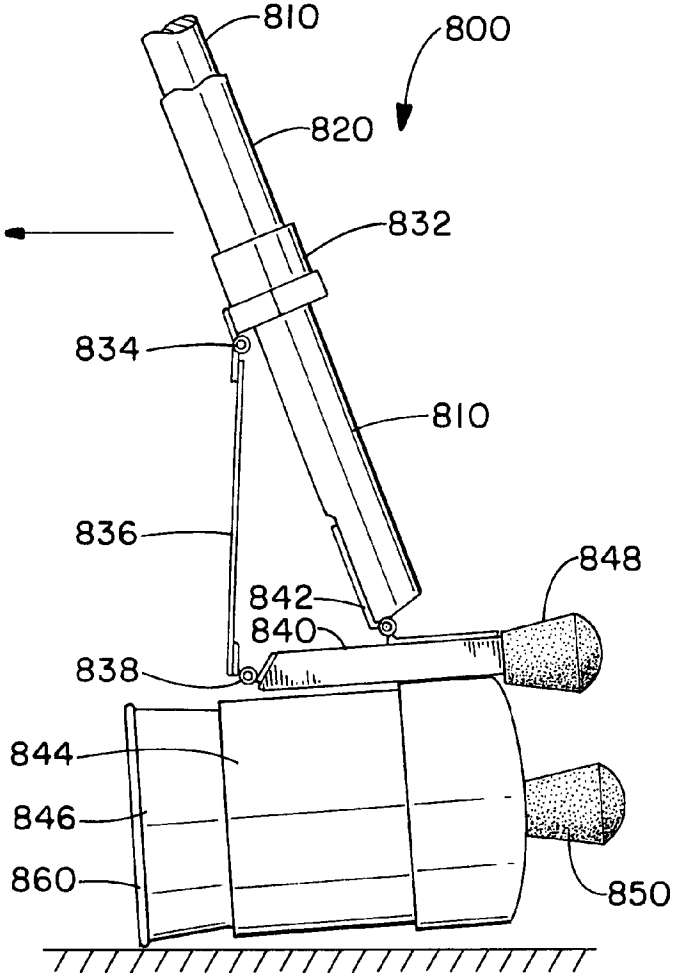
FIG. 22 is an enlarged partial right side elevational elevational view of the eighth embodiment as it may be pulled in the process of using the device.

With reference now to FIGS. 22 and 23, an appreciation can be made of the unique operative structure of the embodiment under consideration. It is often preferable that waste be retrieved by either pushing or pulling the cup 846 into the waste. Different users may find it more convenient to use different approaches, while different types of waste may be more convenient for different types of retrieval. Moreover, the location of the waste itself with regard to other structures or obstacles may dictate whether a pushing or pulling operation is employed. In this regard, the sleeve 820 may be used to orient the cup 846 for retrieval by either a push or pull operation. It will be appreciated that the posture of the device 800 shown in FIGS. 19 and 20 is with the sleeve 820 pulled to its furthest upward position. In this position, the device 800 may be used as a cane or walking stick. When the sleeve is pushed downwardly to a first position where the ball 824 engages with the aperture 822, the movement of the collar 832 upon the shaft 810 effectuates movement of the bracket 840 and attached cup holder 844 to the position shown in FIG. 22. This movement is facilitated by the hinge and linkage arrangement 834, 836, 838 and the hinge 842 interconnecting the shaft 810 and the bracket 840.

If, however, it is desired to employ the device 800 in a push motion for retrieving waste, the sleeve 820 may be slid upon the shaft 810 to a final downward position, and the shaft 810 may be rotated 180° to assume the position shown in FIG. 23 for a push operation. Again, the orientation of the cup 846 is attained by the hinges 834, 838 and interconnecting linkage 836, as well as the hinge interconnection 842.

While the hinges and linkages may be configured to achieve various orientations of the cup holder 844 with the shaft 810, it is preferred that in the pulling operation, the centerline of the shaft 810 and the centerline of the cup holder 844 form an angle of 60°-80°, and preferably on the order of 72°. For the pushing operation, as shown in FIG. 23, it is preferred that the angle formed between the centerline of the shaft 810 and the centerline of the cup holder 844 form an angle of between 45°-70° and preferably 60°.

It will be appreciated that various embodiments of the invention, such as those of FIGS. 8, 11 and 19, by way of example, may employ magazines of both lids and containers, such that a lid and a container does not need to be singularly placed at each use. The receptacles for both the cups and the lids are preferably roughened or knurled inside for a strong grip with the immediately received cup or lid. Moreover, the force of attachment of each lid to a cup is greater than the force of attachment of each lid to adjacent lids in the magazine, so that the lids are attached and payed out one at a time. Similarly, the friction fit between each cup, and ultimately the receptacle for the cups increases into the magazine or stack of cups so that each "filled" cup can be easily and separately removed.

Many embodiments for waste collection devices and systems have been disclosed herein. It will be appreciated that aspects of one device might be incorporated into another. For instance, the leash and flashlight aspects of the embodiment of FIG. 14 might be employed with any of the other embodiments. Containers and container receptacles may take various different forms, and it is particularly preferred that any containers employed be capable of nesting one within the other.

In light of the foregoing, it should thus be evident that the process of the present invention, provides improvements in waste collection devices. While, in accordance with the patent statutes, only the preferred embodiments of the present invention have been described in detail hereinabove, the present invention is not to be limited thereto or thereby. Rather, the scope of the invention shall include all modifications and variations that fall within the scope of the attached claims.

What is claimed is:

1. A waste collecting device comprising:

an elongated shaft having first and second ends;

a handle provided on said first end of said shaft;

a cup holder having a cup release mechanism extending thereinto, said cup release mechanism including a member extending into said cup holder and connected to a lever extending from said cup holder;

a hinged interconnection between said cup holder and said second end of said shaft; and an actuator interposed between said shaft and said hinged interconnection, said actuator and said hinged interconnection effecting pivotal movement of said cup holder about said second end of said shaft between first and second operative extremes, said first operative extreme accommodating waste collection through movement of said shaft in a first direction, and said second operative extreme accommodating waste collection through movement of said shaft in a second direction opposite said first direction.

2. The waste collecting device according to claim 1, wherein said actuator comprises a sleeve slidingly received upon said shaft, said sleeve slidable between two positions upon said shaft.

3. A waste collecting device comprising:

an elongated shaft having first and second ends;

a handle provided on said first end of said shaft;

a cup holder;

a bracket hingedly connected to said second end of said shaft and carrying said cup holder;

a sleeve slidingly received upon said shaft and slidable between a first and second position upon said shaft;

an actuator plate having hinges on opposite ends thereof, the hinge on one end interconnecting with said sleeve and the hinge on the opposite end interconnecting with said bracket such that sliding of said sleeve between said first and second positions effects pivotal movement of said bracket and said cup holder about said second end of said shaft between first and second operative extremes, said first operative extreme accommodating waste collection through movement of said shaft in a first direction, and said second operative extreme accommodating waste collection through movement of said shaft in a second direction opposite said first direction.

* * * * *